United States Patent [19]

Dillon et al.

[11] 4,216,076

[45] Aug. 5, 1980

[54] ANTIFOULANT ADDITIVES FOR HYDROCARBON STREAMS

[75] Inventors: Edward T. Dillon, Pasadena; Lloyd W. Duncan, Big Spring, both of Tex.

[73] Assignee: NL Industries, Inc., New York, N.Y.

[21] Appl. No.: 58,126

[22] Filed: Jul. 16, 1979

Related U.S. Application Data

[62] Division of Ser. No. 857,505, Dec. 5, 1977.

[51] Int. Cl.[2] ..... C10G 9/16; C09K 15/12; C23F 14/02

[52] U.S. Cl. ..... 208/48 AA; 203/8; 208/188; 208/348; 252/8.3; 252/406; 585/950

[58] Field of Search ..... 208/48 AA, 187–188, 208/348; 252/8.3, 406, 402; 203/7–8; 585/950

[56] References Cited

U.S. PATENT DOCUMENTS

| | | | |
|---|---|---|---|
| 2,927,078 | 3/1960 | Nathan | 252/8.3 |
| 3,105,810 | 10/1963 | Miller | 208/48 AA |
| 3,574,088 | 4/1971 | Bsharah et al. | 208/48 AA |
| 3,630,929 | 12/1971 | Van Dijk | 252/136 |
| 3,728,266 | 4/1973 | Komeda et al. | 252/95 |
| 3,951,793 | 4/1976 | Tate et al. | 252/180 |
| 4,005,020 | 1/1977 | McCormick et al. | 252/8.3 |
| 4,024,048 | 5/1977 | Shell et al. | 585/950 |

*Primary Examiner*—Delbert E. Gantz
*Assistant Examiner*—G. E. Schmitkons
*Attorney, Agent, or Firm*—William E. Johnson, Jr.; Douglas H. May, Jr.

[57] ABSTRACT

A method for preventing fouling of equipment used in hydrocarbon processing is provided comprising adding to said hydrocarbon a polyalkyleneoxy sulfoxy salt represented by the formula:

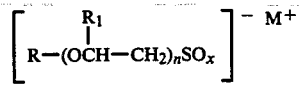

wherein R is a linear alkyl radical having from about 6 to 15 carbon atoms or an alkyl phenyl radical wherein the alkyl group contains from about 8 to 10 carbon atoms, $R_1$ is H or $CH_3$, n is a number from 3 to 8, x is 3 or 4 and $M^+$ is an ammonium or an alkali metal cation.

An antifouling formulation is also provided which comprises an alcohol-water dispersion of the above antifouling agent and a surfactant comprising a fatty acid dialkanol amide.

17 Claims, No Drawings

ANTIFOULANT ADDITIVES FOR HYDROCARBON STREAMS

This is a division of application Ser. No. 857,505, filed Dec. 5, 1977.

This invention is concerned with antifouling agents for hydrocarbon feed streams and a liquid formulation containing said agents.

In refinery processing of hydrocarbon streams, both unrefined and partially refined hydrocarbons are preheated in heat exchange units before being subjected to liquid and/or vapor phase processing such as separation, upgrading and conversion. For example, crude petroleum is first desalted by washing with water, preheated by indirect heat exchange with product stream and then subjected to final preheating in a furnace before it is charged to a distillation unit for the separation and recovery of various petroleum fractions. The heat exchangers used to preheat the crude petroleum generally comprise a series of metal tubes arranged in banks which carry the crude oil. The tubes are encased in a hollow shell into which the hot stream passes. The heat from the stream is conducted through the tubes to the crude petroleum feed which is then led to the next stage of processing.

In a similar manner, topped crude is preheated before being subjected to vacuum distillation for the separation and recovery of hydrocarbon fractions. Other unrefined liquid hydrocarbon streams such as natural gas liquids are also preheated before being subjected to refinery processes. Partially refined liquid hydrocarbons such as virgin gas oil, gas oil from coking, light gas oil, virgin naptha, light and heavy naptha fractions from a distillation unit, paraffin distillates, and oil from catalytic cracking, are also preheated before being subjected to such hydrocarbon conversion processes.

In hydrocarbon separation processes, hydrocarbon enrichment processes and hydrocarbon conversion processes, the unrefined and partially refined liquid hydrocarbon feeds are preheated to temperatures over a wide range depending on the temperature requirements of further processing and depending on the physical phase involved in the further processing. In general, the preheating temperatures range from 300° F. to 1600° F.

One of the major problems encountered in the processing of hydrocarbon streams in fouling which is the formation of deposits, both organic and inorganic, on the metal surfaces of the processing equipment which contain or carry the particular stream i.e., the process side. Such fouling tends to materially decrease the efficiency of the equipment in which it occurs. The direct results of fouling appear in the form of heat transfer loss, increased pressure drop between the heat exchanger equipment outlet and inlet, and loss in throughput. Fouling deposits on the process side consist primarily of high molecular weight organic polymers insoluble in the hydrocarbon stream. The polymers are formed in the hydrocarbon stream presumably by a chemical reaction between nitrogen, sulfur, and unsaturated compounds contained therein. Heat and the presence of oxygen act to accelerate the formation of such polymers.

When fouling deposits accumulate to the degree that process equipment materially loses efficiency such equipment must be disassembled and mechanically and/or chemically cleaned to remove the deposits. This results in interruption of the refining process and reduction in production. With the current emphasis on increased petroleum production, such interruptions are unacceptable.

Several methods have been developed heretofore for controlling or removing fouling deposits from refinery equipment short of removing such equipment from use. Such methods include the control of process variables (temperature, type of feed, velocity, heat, etc.) elimination of oxygen from the feed, the addition of corrosion inhibitors, and the addition of antifouling additives, particularly stabilizer-dispersants. Such stabilizer-dispersants when added to a hydrocarbon stream, act to stabilize the polymer-forming materials while preventing agglomeration of formed polymers so they remain soluble in the refinery stream. The addition of antifouling additives is by far the most efficient and economical method developed so far.

Many such antifouling additives have been described. For example, U.S. Pat. No. 3,492,219 to R. M. Miller teaches adding several oil-soluble metal deactivators to petroleum charge stocks to reduce fouling by complexing with metals in the stocks which catalyze the formation of such fouling deposits. Such metal deactivators include condensation products of salicylaldehyde and organic diamines, o-hydroxylaryl amides of o-hydroxyaryl carboxylic acids, dialkoxy substituted 2,2′-dihydroxy benzanilides, dihalo-2,2′-dihydroxy benzanilides and reaction products of N,N-dialkenyl melamines with salicylaldehyde.

In U.S. Pat. No. 3,261,774 to J. D. Newkirk et al, antifouling additives for normally liquid or gaseous hydrocarbon charge stocks are provided comprising N-alkyl amido phosphoric acids. In U.S. Pat. No. 3,380.909 to R. J. Lee, alkenyl succinimide derivatives of polyamino urea are described for use as fouling inhibitors. In three related U.S. patents to P. C. Shell et al, antifouling additives and methods to prevent fouling are described employing inorganic phosphoric acid salts, (U.S. Pat. No. 4,024,051) and thiophosphate and phosphite mono and di-esters (U.S. Pat. Nos. 4,024,049 and 4,024,050).

The present invention provides a method for preventing and removing fouling deposits caused by hydrocarbon feed streams by adding to said stream certain polyalkyleneoxy sulfoxy salts. These salts act to both remove and prevent the formation of fouling deposits by effectively dispersing such deposits within the hydrocarbon stream. Since the additives are surface active, excessive foaming may be prevented by optionally adding a surfactant to the stream.

A liquid formulation is also provided in this invention containing the antifoulant additive and surfactant which formulation can be dispensed directly and continuously to the hydrocarbon stream. The formulation is soluble-dispersible in the hydrocarbon stream and does not effect product quality.

In one embodiment of this invention, a method for preventing fouling of equipment used in hydrocarbon processing is provided which comprises adding to said hydrocarbon an agent represented by the formula;

$$\left[ R-(O\overset{\overset{R_1}{|}}{C}H-CH_2)_nSO_x \right]^- M^+$$

wherein R is a linear alkyl radical having from about 6 to 15 carbon atoms or an alkyl phenyl radical wherein the alkyl group contains from about 8 to 10 carbon atoms, $R_1$ is H or $CH_3$, n is a number from 3 to 8, x is 3 or 4 and $M^+$ is $NH_4^+$ or an alkali metal cation.

The above agents, that is the polyalkyleneoxy sulfoxy salts, are antifouling agents which not only prevent fouling of the process side of equipment which carry or contain the hydrocarbons but also, in many cases, actually remove fouling deposits already formed on such equipment. They act, in effect, to clean such equipment while it is on line thus obviating the need to remove the equipment from service.

The antifouling agents of this invention are added to the hydrocarbon feed stocks, or streams which commonly cause fouling in intermediate refinery hydrocarbon process equipment such as naphthas or light distillate stocks, gas oils, petroleum gases and crude oils. They are particularly useful as additives to crude oil which is the most common source of fouling deposits.

The direct benefits of adding the antifoulants of this invention to crude oil and other hydrocarbon streams are;

(a) a decrease in the heat required to heat the crude oil resulting in fuel savings;

(b) a decrease in the down time of equipment during trun-around because equipment is rendered clean;

(c) longer runs between turn-arounds; and (d) a decrease in the fouling of distillation units and pumps.

As previously mentioned, crude oil is first washed with water to remove soluble salts as in a desalter. It is then passed through a train or series of heat exchangers heated by a product stream of hot hydrocarbon to preheat the desalted crude whereafter it is further heated and passed to a distillation unit. Generally the crude enters the first heat exchanger at from about 200° to 300° F. and optimally should exit the last heat exchanger at from about 100° F. to 300° F. higher from the inlet temperature. These temperatures depend on the heat conduction efficiency from the shell side of the heat exchanger to the process side, the temperature of the hot product stream, and the flow rate. If the process side is fouled, such efficiency is decreased as a function of the degree of fouling.

In order to ascertain the degree of fouling the $\Delta T$ across the heat exchangers is calculated. $\Delta T$ is defined as the the difference between the temperature of the hydrocarbon stream e.g. crude oil, at the outlet of a given heat exchanger unit and the inlet. Total $\Delta T$ is the sum of each $\Delta T$ for each heat exchanger unit in a train.

Pressure differential across the outlet and inlet of the heat exchanger equipment is another variable which indicates fouling. If this pressure differential, $\Delta P$, increases while all other variables remain constant, inadequate heat exchange caused by fouling is indicated.

By virtue of the prevention and reduction of fouling using the agents of this invention, stable or increased $\Delta T$'s across the heat exchangers are achieved as well as a stabilized or decreased pressure differential, $\Delta P$.

Optionally, but preferably, a surfactant is added to the hydrocarbons along with the antifouling agent of this invention. These compounds are nonionic surfactants comprising fatty acid alkanol amides which may also contain a small amount of an anionic surfactant and act to enhance the effectiveness of the anionic polyalkyleneoxy sulfoxy salts.

A liquid formulation containing the antifouling agent and surfactant of this invention is also provided which allows convenient, efficient, and continuous metering of the antifouling agent and surfactant to the hydrocarbon stream. Addition may optionally be carried out batch wise or continuously as desired.

The antifouling agent of this invention is a polyalkyleneoxy sulfoxy salt represented by Formula 1 below;

$$\left[ R-(O\overset{R_1}{\overset{|}{C}}H-CH_2)_n SO_x \right]^- M^+ \qquad \text{Formula 1}$$

wherein R is a linear alkyl radical having from about 6 to 15 carbon atoms or an alkyl phenyl radical wherein the alkyl group contains from about 8 to 10 carbon atoms, $R_1$ is H or $CH_3$, n is a number from 3 to 8, x is 3 or 4 and $M^+$ is $NH_4^+$ or an alkali metal cation.

The preferred polyalkyleneoxy sulfoxy salts are polyethoxylated alcohol sulfates wherein R in Formula 1 is a linear alkyl radical having from 8 to 10 carbon atoms, $R_1$ is H, n is 3, x is 4 and M is an ammonium cation. Such polyethoxylated alcohol sulfates can be represented by Formula 2 below:

$$[CH_3(CH_2)_y-CH_2-(OCH_2-CH_2)_n OSO_3]^- NH_4^+ \qquad \text{Formula 2}$$

wherein y is a number from 4 to 8.

Other polyalkyleneoxy sulfoxy salts useful in this invention include ethoxylated alkyl phenol sulfates and sulfonates wherein R in Formula 1 is an alkyl phenyl radical wherein the alkyl group contains from 8 to 10 carbon atoms, $R_1$ is H, n is a number from 2 to 4, x is 3 or 4, and $M^+$ is $NH_4^+$, $Na^+$ or $K^+$. Such ethoxylated alkyl phenol sulfates and sulfonates can be represented by Formula 3 below:

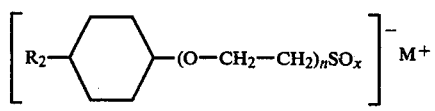

Formula 3 wherein $R_2$ is an alkyl radical having from 8 to 10 carbon atoms, n is a number from 2 to 4, x is 3 or 4 and $M^+$ is $NH_4$, $Na^+$, or $K^+$.

The polyalkyleneoxy sulfoxy salts can be synthesized by techniques well known in the art. For example, an alkanol or alkyl phenol having appropriate R or $R_2$ groups as in the above formula may be first condensed with 3 to 8 moles of an alkylene oxide such as ethylene oxide or propylene oxide to form a primary alcohol-terminated alkylene oxide condensate. The alcohol is then reacted with an appropriate sulfating or sulfonating agent. The acid sulfate or sulfonate derivative is then neutralized with ammonium or alkali metal base to form the polyalkyleneoxy sulfoxy salt.

The above polyalkyleneoxy sulfoxy salts act to disperse the organic and inorganic material which is deposited or which tends to be deposited in refinery equipment, i.e., heat exchangers, boilers, furnaces, condensers and pumps. In order to enhance the effectiveness of the antifouling agent, it is preferred to use a surfactant as an additive with the antifouling agent of this invention.

The surfactant component of the antifouling agent of this invention is a nonionic fatty acid diethanol amide represented by the formula;

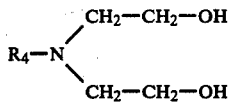

wherein $R_4$ is a fatty acid radical having from about 8 to 22 carbon atoms.

Such components can be prepared by reacting a fatty acid having 8 to 22 carbon atoms with diethanol amine.

The preferred surfactant component is coconut oil fatty acid diethanol amide wherein $R_4$ comprises a mixture of fatty acid radicals of from about 8 to 18 carbon atoms. Coconut oil fatty acid contains predominantly $C_{12}$ and $C_{14}$ alkyl groups and minor amounts of $C_8$, $C_{10}$, $C_{16}$, and $C_{18}$, radicals. The surfactant component may also contain a small amount of an anionic surfactant such as an amine sulfonate.

The antifouling agent and surfactant of this invention may be added simultaneously and continuously to the hydrocarbon feed or may be combined first and then added to the feed. Generally, the amount of antifouling agent added should be from about 1.5 to about 150 parts per million (ppm) based on the hydrocarbon feed and preferably about 5 to about 50 ppm. The surfactant may be added in amounts of from 5% to 30% of the weight of the antifouling agent. The antifouling agent and surfactant are preferably added to the hydrocarbon stream as a liquid.

The preferred formulation comprises from about 30% to about 40% by weight water, 20% to 30% by weight water-soluble alcohol such as methanol, 30% to 40% by weight anti-fouling agent, 2% to 8% by weight surfactant agent and optionally from 0.05 to 2.0% by weight solubilizing agent such as disodium phosphate.

In preparing the liquid formulation, the antifouling agent and surfactant are first dissolved in the alcohol. The water is next added to the alcohol solution with thorough mixing followed by the addition of the solubilizing agent. All components are thoroughly mixed to provide a homogeneous mixture (solution-dispersion).

The following examples are given to illustrate the invention, but are not deemed to be limiting thereof. All percentages given are based upon weight unless otherwise indicated.

EXAMPLE 1

Three different West Coast napthenic crude oil identified as Type A, Type B, and Type C were used to evaluate an antifoulant formulation comprising about:

(a) 34.9% water (b) 25% methanol (c) 35% of an antifouling agent represented by the formula;

$$[CH_3(CH_2)_y-CH_2-(OCH_2-CH_2)_3\,OSO_3]-NH_4+$$

where Y is 6 to 8;

(d) about 5% by weight of coconut oil fatty acid diethanol amide and (e) 0.1% by weight of disodium phosphate.

Each crude oil was allowed to foul a clean, previously weighed, heater tube in three parallel experiments. The weight of the heater tube was measured after fouling occurred. The difference between the final weight and the initial weight is a measure of fouling tendency.

After the heater tube was weighed, it was replaced in the system. Each of the crude oils previously used was again passed through the heater tubes with the addition of about 20 ppm of the antifoulant formulation. A weight loss indicates cleaning of the fouling deposits. A weight gain indicated the formation of fouling deposits.

Fouling tendency was carried out in a Jet Fuel Thermal Fouling Tester identified as Model JFTOT-208 manufactured by Alcor, Inc. Results are set forth in Table I.

TABLE I

| Crude Type | Formulation Added | Heater Tube Weight Gain/Loss (gms) |
|---|---|---|
| A | No | 0.0051 g. gain |
| A | Yes | 0.0026 g. loss |
| B | No | 0.0029 g. gain |
| B | Yes | 0.0025 g. loss |
| C | No | 0.0252 g. gain |
| C | Yes | 0.0097 g. gain |

As the table shows, the antifoulant of this invention actually cleaned fouling deposits caused by Crude A and Crude B. In the case of Crude C, there was no cleaning but the increase in fouling was about 62% less than if no antifoulant was used.

EXAMPLE 2

This Example illustrates the effect on ΔT and ΔP of a heat exchanger train and ΔT of a heater by addition of an anti-fouling agent of this invention to a sour West Texas crude oil preheated by such heat exchangers during actual commerical use.

About 20 ppm of the formulation of Example 1 was continuously added to a crude oil stream after desalting. The crude oil was preheated in a tube-type heat exchanger train and then heated again in a heater before being led to a distillation unit for further processing. Measurements of the temperatures and pressures of crude oil at the inlet and outlet of the heat exchangers and of the temperatures of the heater product stream were taken over a period of 10 weeks. From this data, ΔT and ΔP of the heat exchanger train and ΔT of the heater were calculated.

The results are set forth in Table II.

TABLE II

| Time (weeks) | ΔT Heat Exchanger (°F.) | ΔP Heat Exchanger (psig) | ΔT Heater (°F.) |
|---|---|---|---|
| 1 | 198 | 122 | 237 |
| 2 | 210 | 128 | 231 |
| 3 | 220 | 127 | 225 |
| 4 | 230 | 123 | 218 |
| 5 | 225 | 120 | 221 |
| 6 | 228 | 123 | 219 |
| 7 | 231 | 121 | 215 |
| 8 | 223 | 122 | 214 |
| 9 | 230 | 120 | 212 |
| 10 | 239 | 119 | 211 |

As Table II shows the ΔT in the heat exchanger train went from about 198° F. to 230° F. within four weeks and except for minor fluctuations remained near that level and then increased at the tenth week to 239° F.

The ΔP of the heat exchanger train stayed fairly constant. The ΔT of the heater decreased rather steadily over the 10 week test period from 237° F. to 211° F. indicating more efficient heat conduction.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A method for preventing fouling of equipment used in hydrocarbon processing which comprises adding to said hydrocarbon an antifouling agent represented by the formula;

$$\left[ R-(O\overset{R_1}{\overset{|}{C}}H-CH_2)_nSO_x \right]^- M^+$$

wherein R is a linear alkyl radical having from about 6 to 15 carbon atoms or an alkyl phenyl radical wherein the alkyl group contains from about 8 to 10 carbon atoms, $R_1$ is H or CH, n is a number from 3 to 8, x is 3 or 4 and $M^+$ is an ammonium or an alkali metal cation.

2. The method of claim 1 wherein R is a linear alkyl radical having from 8 to 10 carbon atoms, $R_1$ is H, n is 3, x is 4 and $M^+$ is an ammonium cation.

3. The method of claim 1 wherein R is an alkyl phenyl radical wherein the alkyl group contains from 8 to 10 carbon atoms, $R_1$ is H, n is a number from 2 to 4, x is 3 or 4 and $M^+$ is selected from the group consisting of $NH_4^+$, $Na^+$ and $K^+$.

4. The method of claim 1 wherein the amount of anti-fouling agent added is from about 1.5 to about 150 parts per million based on the hydrocarbon.

5. The method of claim 1 wherein the amount of anti-fouling agent added is from about 5 to about 50 parts per million based on the hydrocarbon.

6. The method of claim 1 which further comprises adding to said hydrocarbon a surfactant represented by the formula;

$$R_4-N(CH_2-CH_2-OH)_2$$

wherein $R_4$ is a fatty acid radical containing from about 8 to 22 carbon atoms.

7. The method of claim 6 wherein $R_4$ is a coconut oil fatty acid radical.

8. The method of claim 6 wherein said surfactant is added to said hydrocarbon in an amount from 5% to 30% by weight of said antifouling agent.

9. The method of claim 6 wherein said surfactant further comprises an anionic surfactant.

10. The method of claim 9 wherein said anionic surfactant is an amine sulfonate.

11. A method for preventing fouling of equipment used in hydrocarbon processing which comprises adding to said hydrocarbon an antifouling agent represented by the formula;

$$[CH_3(CH_2)_y-CH_2-(OCH_2-CH_2)_3OSO_3]^-NH_4^+$$

wherein y is a number from 4 to 8.

12. The method of claim 11 wherein the amount of antifouling agent added to said hydrocarbon is from about 1.5 to about 150 parts per million based on said hydrocarbon.

13. The method of claim 11 which further comprises adding to said hydrocarbon a surfactant represented by the formula;

$$R_4-N(CH_2-CH_2-OH)_2$$

wherein $R_4$ is a coconut oil fatty acid radical.

14. The method of claim 13 wherein said surfactant is added to said hydrocarbon in an amount of from 5% to 30% by weight of said antifouling agent.

15. The method of claim 13 wherein said surfactant further comprises an amine sulfonate.

16. A method for preventing fouling of equipment used in hydrocarbon processing which comprises adding to said hydrocarbon from 5 to 50 parts per million of antifouling agent represented by the formula;

$$[CH_3(CH_2)_y-CH_2-(OCH_2-CH_2)_3OSO_3]^-NH_4^+$$

wherein y is a number from 4 to 8 and from 5% to 30.0% by weight of said antifouling agent of a surfactant represented by the formula;

$$R_4-N(CH_2-CH_2-OH)_2$$

wherein $R_4$ is coconut oil fatty acid radical.

17. The method of claim 16 wherein said surfactant further comprises an anionic surfactant.

* * * * *